US008917305B2

(12) United States Patent
Nakahata et al.

(10) Patent No.: US 8,917,305 B2
(45) Date of Patent: Dec. 23, 2014

(54) LIGHT SCANNING APPARATUS AND IMAGE FORMING APPARATUS INCLUDING LIGHT SCANNING APPARATUS

(71) Applicant: Canon Kabushiki Kaisha, Tokyo (JP)

(72) Inventors: Hiroshi Nakahata, Abiko (JP); Toshiharu Mamiya, Yokohama (JP); Yuta Okada, Moriya (JP); Shinichiro Hosoi, Tokyo (JP); Yasutomo Furuta, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/860,383

(22) Filed: Apr. 10, 2013

(65) Prior Publication Data

US 2013/0286143 A1 Oct. 31, 2013

(30) Foreign Application Priority Data

Apr. 26, 2012 (JP) ..... 2012-100971

(51) Int. Cl.

| | |
|---|---|
| ***B41J 15/14*** | (2006.01) |
| ***B41J 27/00*** | (2006.01) |
| ***G03G 15/041*** | (2006.01) |
| ***G03G 15/043*** | (2006.01) |

(52) U.S. Cl.

CPC ..... *G03G 15/0415* (2013.01); *G03G 15/043* (2013.01)

USPC ..... 347/244; 347/258

(58) Field of Classification Search

USPC ..... 347/229, 233–235, 248–250, 241, 244, 347/256, 258

See application file for complete search history.

(56) References Cited

U.S. PATENT DOCUMENTS

| | | | | |
|---|---|---|---|---|
| 7,072,087 | B2 | 7/2006 | Nakahata | 359/204 |
| 7,298,390 | B2 | 11/2007 | Nakahata | 347/231 |
| 7,528,856 | B2 * | 5/2009 | Kato et al. | 347/242 |
| 7,629,992 | B2 | 12/2009 | Nakahata | 347/243 |
| 7,728,861 | B2 | 6/2010 | Nakahata | 347/231 |
| 7,760,228 | B2 | 7/2010 | Mamiya | 347/257 |
| 7,830,576 | B2 | 11/2010 | Nakahata | 359/201.1 |
| 8,594,533 | B2 * | 11/2013 | Naito | 399/151 |
| 2003/0156183 | A1 * | 8/2003 | Ishihara | 347/234 |
| 2012/0081770 | A1 | 4/2012 | Sato et al. | 359/204.1 |

FOREIGN PATENT DOCUMENTS

| | | | |
|---|---|---|---|
| JP | 2001066526 A | * | 3/2001 |
| JP | 2008-089695 | | 4/2008 |
| JP | 2011-048085 | | 3/2011 |

OTHER PUBLICATIONS

U.S. Appl. No. 13/862,164, filed Apr. 12, 2013; Hiroshi Nakahata.

U.S. Appl. No. 13/866,792, filed Apr. 19, 2013; Toshiharu Mamiya, et al.

* cited by examiner

*Primary Examiner* — Hai C Pham

(74) *Attorney, Agent, or Firm* — Fitzpatrick, Cella, Harper & Scinto

(57) ABSTRACT

A resin BD lens having a property of refracting a light beam in a direction corresponding to a main scanning direction may cause a variation in generation timing difference among a plurality of horizontal synchronization signals and accordingly degrade accuracy to correct the starting position of an electrostatic latent image. The present invention uses a glass BD lens having a property of refracting a light beam in a direction corresponding to the main scanning direction.

12 Claims, 10 Drawing Sheets

LIGHT SCANNING APPARATUS AND IMAGE FORMING APPARATUS INCLUDING LIGHT SCANNING APPARATUS

BACKGROUND OF THE INVENTION

1. Field of the Invention

The present invention relates to light scanning apparatuses including a light source that emits a plurality of light beams for exposure of a photosensitive member, and image forming apparatuses including the light scanning apparatus.

2. Description of the Related Art

Conventionally known image forming apparatuses are configured to deflect a light beam emitted from a light source by a rotary polygon mirror and scan a photosensitive member with the light beam deflected by the rotary polygon mirror to form an electrostatic latent image on the photosensitive member. Such an image forming apparatus is provided with an optical sensor to detect a light beam deflected by the rotary polygon mirror. The optical sensor generates a synchronization signal, based on which a light beam is emitted from the light source, thus bringing starting positions of electrostatic latent images (images) into coincidence with each other in the scanning direction (main scanning direction) of the light beam on the photosensitive member.

For a higher image forming speed and higher resolution of images, a known image forming apparatus includes a light source in which a plurality of light emitting elements each emitting a light beam are arranged as shown in FIG. 9A. In FIG. 9A, X-axis direction corresponds to the main scanning direction and Y-axis direction corresponds to the rotational direction (vertical scanning direction) of the photosensitive member. Such an image forming apparatus is adjusted in the assembly process at the factory about an interval between the light emitting elements in Y-axis direction while rotating the light source in the direction of the arrow shown in FIG. 9A. While rotating the light source in this way, an interval between exposure positions on the photosensitive member in the vertical scanning direction of the light beams emitted from the light emitting elements is adjusted to be an interval corresponding to the resolution of the image forming apparatus.

As the light source rotates in the direction of the arrow shown in FIG. 9A, however, an interval between the light emitting elements changes not only in Y-axis direction but also in X-axis direction. Then, a conventional image forming apparatus includes an optical sensor generating a horizontal synchronization signal, based on which each light emitting element is allowed to emit a light beam at a timing specified for the light emitting element, thus bringing the starting positions of the electrostatic latent images into coincidence with each other.

In the aforementioned assembly process, the angle (adjustment amount) to rotate the light source is different for each imaging forming apparatus because the light source may be differently mounted in different image forming apparatuses or optical members such as lenses and mirrors have different optical properties. This means that a plurality of image forming apparatuses have different intervals between light emitting elements in X-axis direction after the rotation adjustment of their light sources. In that case, when the emission timings of light beams from the light emitting elements are uniformly set for all image forming apparatuses based on the synchronization signal generated by the optical sensor, then some of the imaging forming apparatuses may have a starting position of an electrostatic latent image displaced in the main scanning direction.

In order to suppress such displacement of the starting position of an electrostatic latent image in the main scanning direction due to the rotation of the light source in the assembly process, Japanese Patent Application Laid-Open No. 2008-89695 discloses an image forming apparatus including a first light emitting element and a second light emitting element, each of which emits a light beam. A plurality of horizontal synchronization signals are generated based on the light beams emitted, and based on a difference in generation timing between the plurality of horizontal synchronization signals, an emission timing of a light beam from the second light emitting element is set with reference to the emission timing of a light beam from the first light emitting element.

Japanese Patent Application Laid-Open No. 2011-48085 discloses a light scanning apparatus including a lens made of resin as an fθ lens and including an optical sensor to receive a light beam passing through a light-gathering lens (BD lens) different from the fθ lens, thus generating a synchronization signal.

The BD lens of Japanese Patent Application Laid-Open No. 2011-48085 made of resin similarly to the fθ lens leads to the following problem. A BD lens has a property of refracting a light beam in the direction corresponding to the main scanning direction. As the temperature inside the light scanning apparatus increases due to the rotation of the rotary polygon mirror, the property of the BD lens to refract a light beam changes, resulting in the possibility of changing a generating timing of a horizontal synchronization signal. In the case of the image forming apparatus disclosed by Japanese Patent Application Laid-Open No. 2008-89695, detected generating timings of the plurality of horizontal synchronization signals are affected by the change in properties of the BD lens, so that the difference in generation timing between the plurality of horizontal synchronization signals will change and thus accuracy to correct the starting position of an electrostatic latent image will deteriorate.

SUMMARY OF THE INVENTION

In view of the aforementioned problems, a light scanning apparatus of the present invention includes a light source including a plurality of light emitting elements arranged therein, the plurality of light emitting elements emitting a plurality of light beams for exposure of a rotary-driven photosensitive member at different positions in a rotational direction, emission timings of the plurality of light beams from the plurality of light emitting elements being controlled on a basis of a synchronization signal. The light scanning apparatus includes: a deflection unit that deflects the plurality of light beams for scanning the photosensitive member; a first lens made of resin receiving the plurality of light beams deflected by the deflection unit as incident light and refracting the incident plurality of light beams in a scanning direction where the plurality of light beams scan the photosensitive member; a second lens made of glass disposed on an optical path of a light beam so as to receive the light beam deflected by the deflection unit as incident light, the second lens refracting the incident light beam in a direction corresponding to the scanning direction; and a light receiving element that receives a light beam passing through the second lens and generates the synchronization signal.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Embodiment 1

Figure 1:
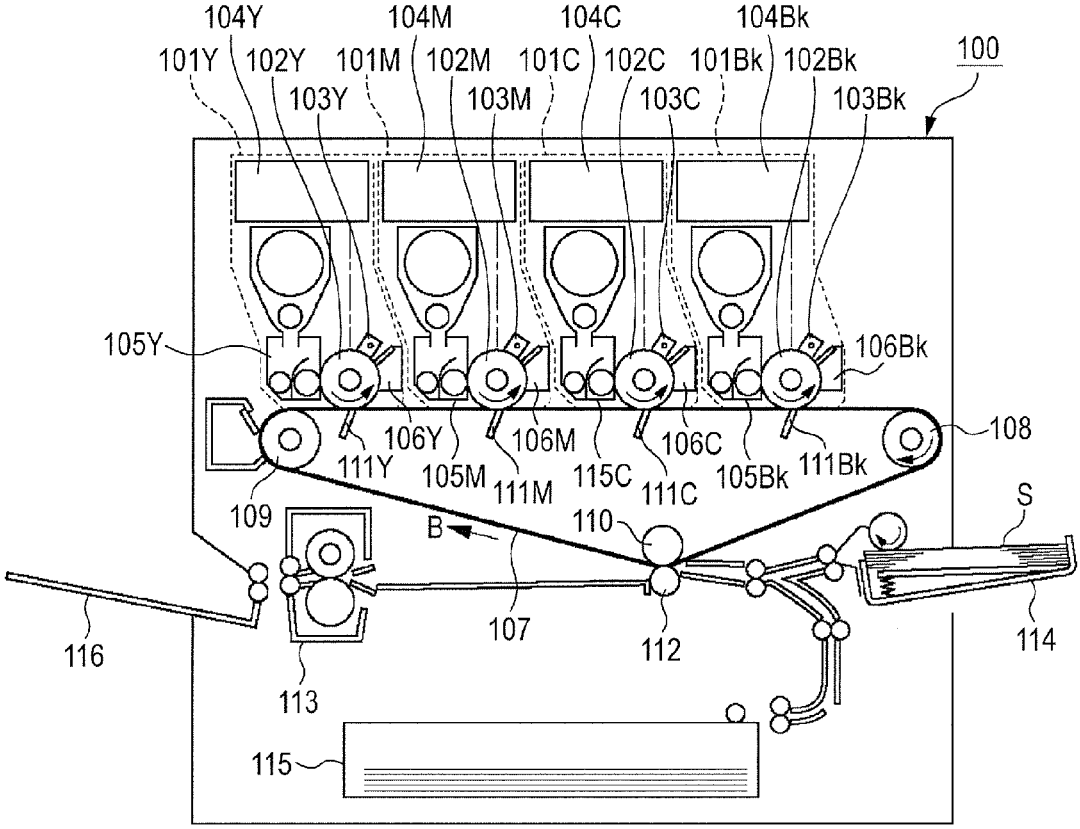
FIG. 1 is a schematic cross-sectional view of a color image forming apparatus.

FIG. 1 is a schematic cross-sectional view of a digital full-color printer (color image forming apparatus) configured to form an image using toner in multiple colors. Although the present embodiment is described below by way of an example of the color image forming apparatus, embodiments are not limited to the color image forming apparatus and may be an image forming apparatus configured to form an image using a single-colored toner only (e.g., black).

Referring to FIG. 1, an image forming apparatus 100 of the present embodiment is described below. The image forming apparatus 100 includes four imaging forming units 101Y, 101M, 101C and 101Bk to form different-colored images. Herein, Y, M, C and Bk represent yellow, magenta, cyan and black, respectively. The image forming units 101Y, 101M, 101C and 101Bk form images using toner in yellow, magenta, cyan and black, respectively.

The image forming units 101Y, 101M, 101C and 101Bk include, as a photosensitive member, photosensitive drums 102Y, 102M, 102C and 102Bk, respectively. Around the photosensitive drums 102Y, 102M, 102C and 102Bk are provided charging devices 103Y, 103M, 103C and 103Bk, light scanning apparatuses 104Y, 104M, 104C and 104Bk and developing devices 105Y, 105M, 105C and 105Bk, respectively. Around photosensitive drums 102Y, 102M, 102C and 102Bk are further arranged drum cleaning devices 106Y, 106M, 106C and 106Bk, respectively.

Below the photosensitive drums 102Y, 102M, 102C and 102Bk is provided an intermediate transfer belt 107 in an endless belt form. The intermediate transfer belt 107 is laid across in a tensioned state on a driving roller 108 and idle rollers 109 and 110, and the intermediate transfer belt 107 rotates in the direction of arrow B in the drawing during image formation. At positions opposed to the photosensitive drums 102Y, 102M, 102C and 102Bk via the intermediate transfer belt 107 (intermediate transfer member) are provided first transfer devices 111Y, 111M, 111C and 111Bk, respectively.

The image forming apparatus 100 of the present embodiment further includes a second transfer device 112 to transfer a toner image on the intermediate transfer belt 107 to a recording medium S and a fixing device 113 to fix the toner image on the recording medium S.

The following describes image forming process by the thus configured image forming apparatus 100, including charging process to developing process. Since each image forming unit performs the same image forming process, the image forming process is described by way of an example of the image forming unit 101Y, and the descriptions on the image forming process by the image forming units 101M, 101C and 101Bk are omitted.

Firstly, the charging device of the image forming unit 101Y charges the photosensitive drum 102Y that is rotary driven. The charged photosensitive drum 102Y (image bearing member) is exposed to laser light emitted from the light scanning apparatus 104Y. Thereby, an electrostatic latent image is formed on the rotating photosensitive member. Thereafter, the electrostatic latent image is developed by the developing device 105Y as a yellow toner image.

The following describes the image forming process at the transferring process or later by way of an example of the image forming units. The first transfer devices 111Y, 111M, 111C and 111Bk apply transfer bias to the transfer belt, whereby toner images in yellow, magenta, cyan and black formed on the photosensitive drums 102Y, 102M, 102C and 102Bk of the image forming units are transferred to the intermediate transfer belt 107. Thereby, toner images in respective colors are overlaid on the intermediate transfer belt 107.

After transferring the four-colored toner image on the intermediate transfer belt 107, the four-colored image transferred to the intermediate transfer belt 107 is transferred again (second-transfer) by the second transfer device 112 to a recording medium S that is conveyed to the second transfer part T2 from a manually feeding cassette 114 or from a sheet supplying cassette 115. Then, the toner image on the recording medium S is fixed by heat at the fixing device 113, and the sheet is discharged to a discharging unit 116, thus obtaining a full-color image on the recording medium S.

After finishing the transferring, the remaining toner on the photosensitive drums 102Y, 102M, 102C and 102Bk are removed by the drum cleaning devices 106Y, 106M, 106C and 106Bk, respectively, and thereafter the above image forming process is continuously performed.

Referring next to FIGS. 2A to 2D, the configuration of the light scanning apparatuses 104Y, 104M, 104C and 104Bk is described below. Since these light scanning apparatuses have the same configuration, the following description omits letters Y, M, C and Bk indicating colors. The light scanning apparatus 104 has an optical box 200, inside which the following various optical components are contained.

Figure 2A:
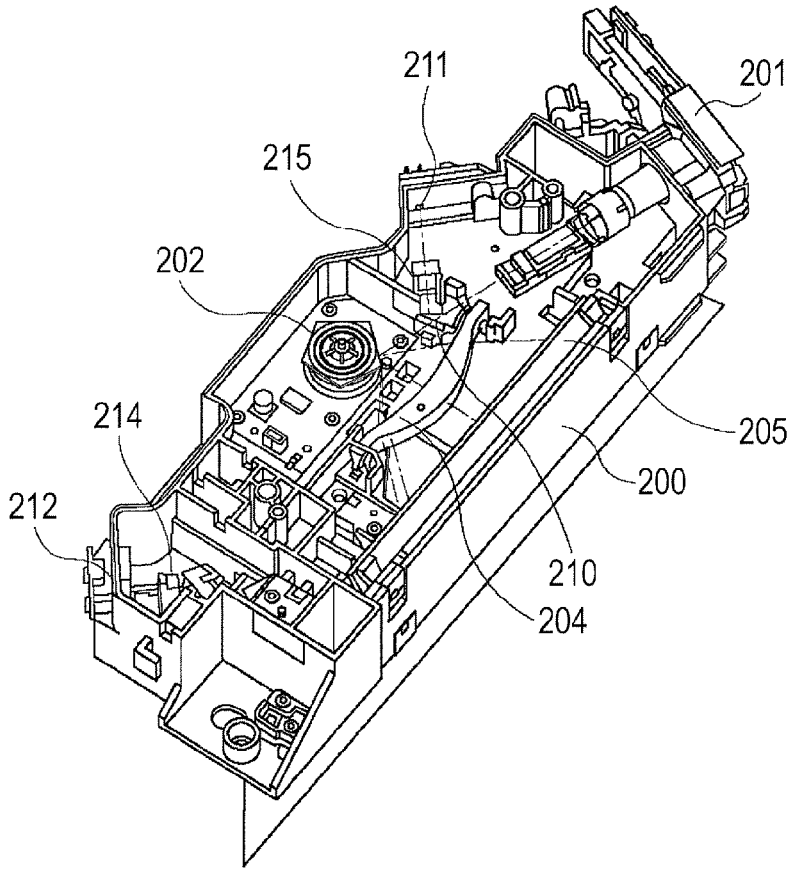
FIG. 2A is a perspective view of a light scanning apparatus.
Figure 2B:
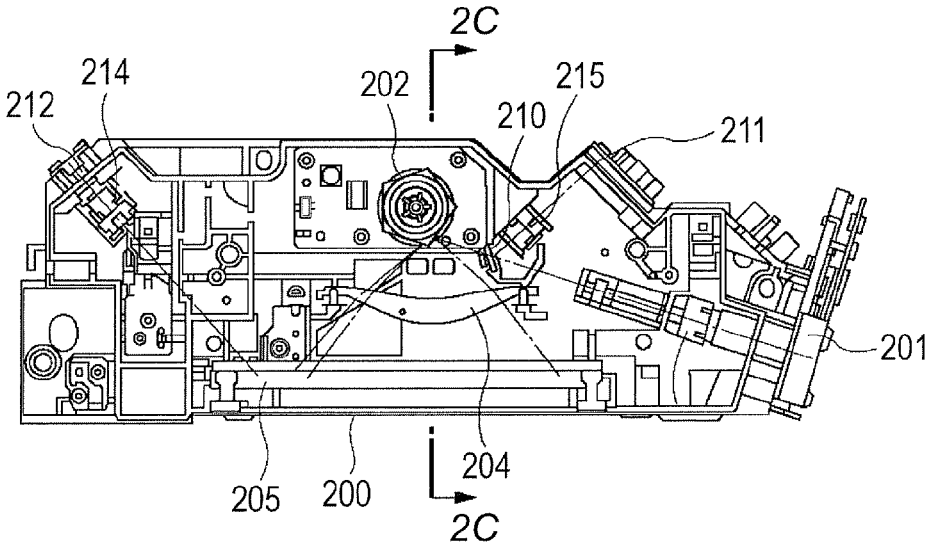
FIG. 2B is a top view of the light scanning apparatus.
Figure 2C:
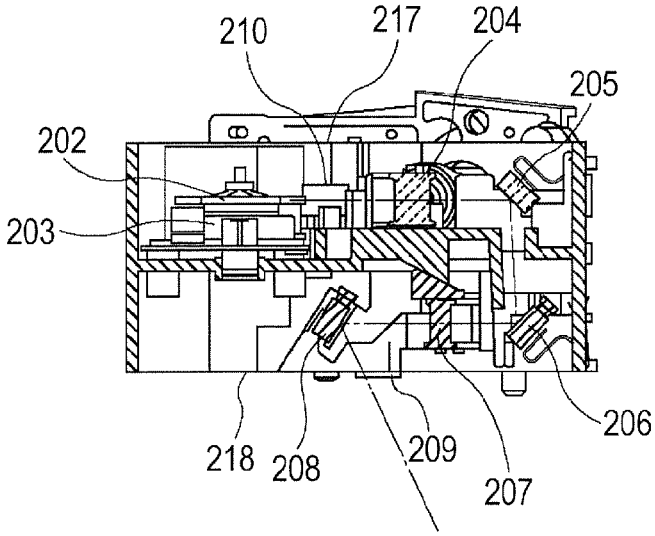
FIG. 2C is a cross-sectional view of the light scanning apparatus.
Figure 2D:
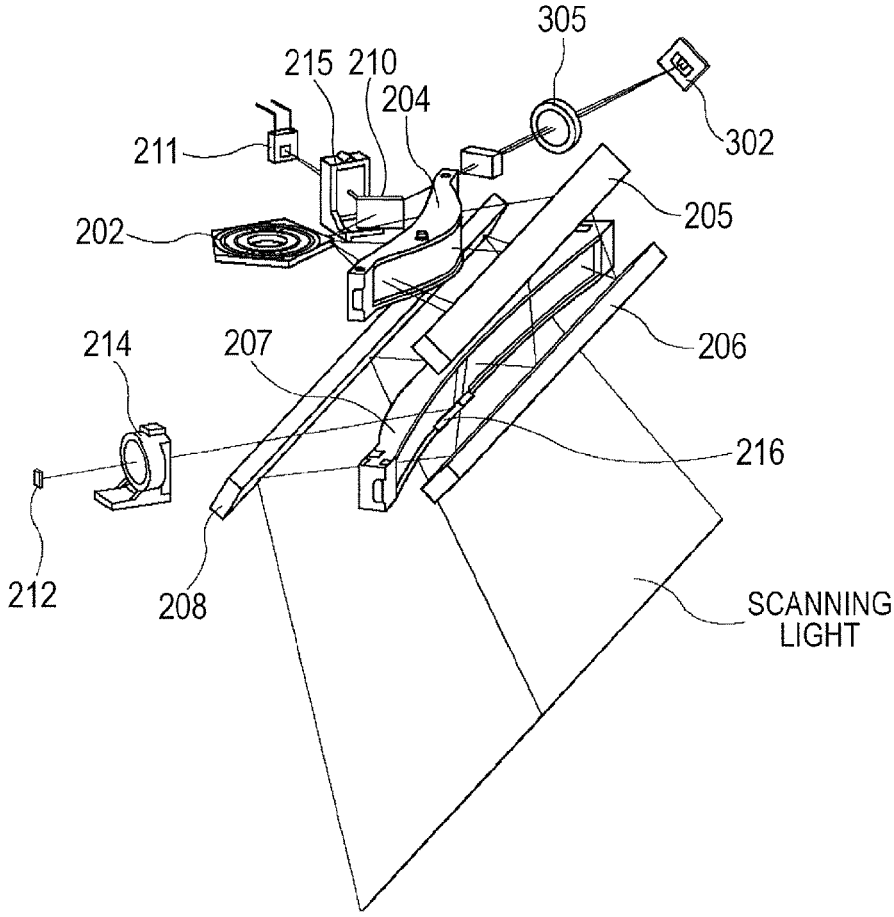
FIG. 2D shows the major configuration of the light scanning apparatus.

FIG. 2A is a perspective view of the light scanning apparatus 104, FIG. 2B is a top view of the light scanning apparatus 104, FIG. 2C is a cross-sectional view taken along line 2C-2C in FIG. 2B and FIG. 2D is a perspective view showing the configuration of major optical components. As shown in FIG. 2A, the optical box 200 (housing) includes an optical unit 201 attached thereto, which is described later. Inside the optical box 200 is provided a rotary polygon mirror 202 that is a deflection unit to deflect laser light emitted from the optical unit 201 for scanning the photosensitive drum with the laser light in a predetermined direction. The rotary polygon mirror 202 is rotary-driven by a motor 203 shown in FIG. 2C. Laser light deflected by the rotary polygon mirror 202 enters an fθ lens 204 (a first lens). The first fθ lens 204 is aligned by an alignment unit 219 provided on an incident face side through which laser light enters. Laser light passing through the first fθ lens 204 is reflected by a reflecting mirror 205 and a reflecting mirror 206 (see FIGS. 2C and 2D), and enters an fθ lens 207. Laser light passing through the fθ lens 207 is then reflected by a reflecting mirror 208, and passes through a dust-proof glass 209, thus leading to the photosensitive drum. Laser light scanned at a uniform angular speed by the rotary polygon mirror 202 forms an image on the photosensitive member via the first fθ lens 204 and the fθ lens 207, and scanning with the laser light is performed at a uniform speed on the photosensitive member.

The first fθ lens 204 and the fθ lens 207 are optical components to convert laser light deflected by the rotary polygon mirror 202 into scanning light scanning the photosensitive member at a uniform speed. At least one of the first fθ lens 204 and the fθ lens 207 has a refractive power (property) to refract incident laser light in the main scanning direction. In the present embodiment, both of the first fθ lens 204 and the fθ lens 207 have a refractive power to refract incident laser light in the main scanning direction. Further, at least one of the first fθ lens 204 and the fθ lens 207 may be a lens made of resin. In the present embodiment, both of the first fθ lens 204 and the fθ lens 207 are made of resin.

The light scanning apparatus 104 of the present embodiment includes a beam splitter 210 as a light beam separation unit. The beam splitter 210 is disposed on an optical path of laser light emitted from the optical unit 201 and directed to the rotary polygon mirror 202. In the present embodiment, the beam splitter 210 is disposed between the optical unit 201 and the rotary polygon mirror 202. Laser light incident on the beam splitter 210 is separated into first laser light (first laser beam) as transmission light and second laser light (second laser beam) as reflection light.

The beam splitter 210 has an incident face (the face on the optical unit 201 side) through which laser light enters, provided with coating (film) to have certain reflectivity (transmissivity). An emission face through the first laser light emits (the face on the rotary polygon mirror 202 side) has a slight angular difference from the incident face so that, even when internal reflection of the laser light occurs at the emission face, the laser light internally reflected can be guided in a direction different from the second laser light reflected from the incident face. That is, the incident face and the emission face are not in parallel with each other.

The first laser light is deflected by the rotary polygon mirror 202 and is guided to the photosensitive drum as stated above. The second laser light passes through a light-gathering lens 215 shown in FIG. 2A, and then enters a photodiode 211 (hereinafter called PD 211) as an optical sensor (light receiving element) described later. The light-gathering lens 215 is disposed on a line connecting the PD 211 and the beam splitter 210. To miniaturize the light scanning apparatus 104 and reduce the cost thereof, no reflecting mirror is disposed on the optical path of the second laser light. The PD 211 outputs a detection signal corresponding to the amount of received light, and on the basis of the output detection signal, automatic light amount control (automatic power control (APC)) described later is performed.

The light scanning apparatus 104 in the present embodiment further includes a beam detector 212 (hereinafter called BD 212) that generates a synchronization signal to decide an emission timing of laser light based on image data on the photosensitive drum. As shown in FIG. 2D, laser light (first laser light) deflected by the rotary polygon mirror 202 passes through the first fθ lens 204, is reflected from the reflecting mirror 205 and a reflecting mirror 206 and enters a BD lens 214 described later. Then, the laser light passing through the BD lens 214 enters the BD 212.

As shown in FIG. 2D, the optical box 200 has a shape having open faces at the top and bottom, and thus an upper cover 217 and a lower cover 218 are attached to the optical box 200 for hermetic sealing.

Figure 3:
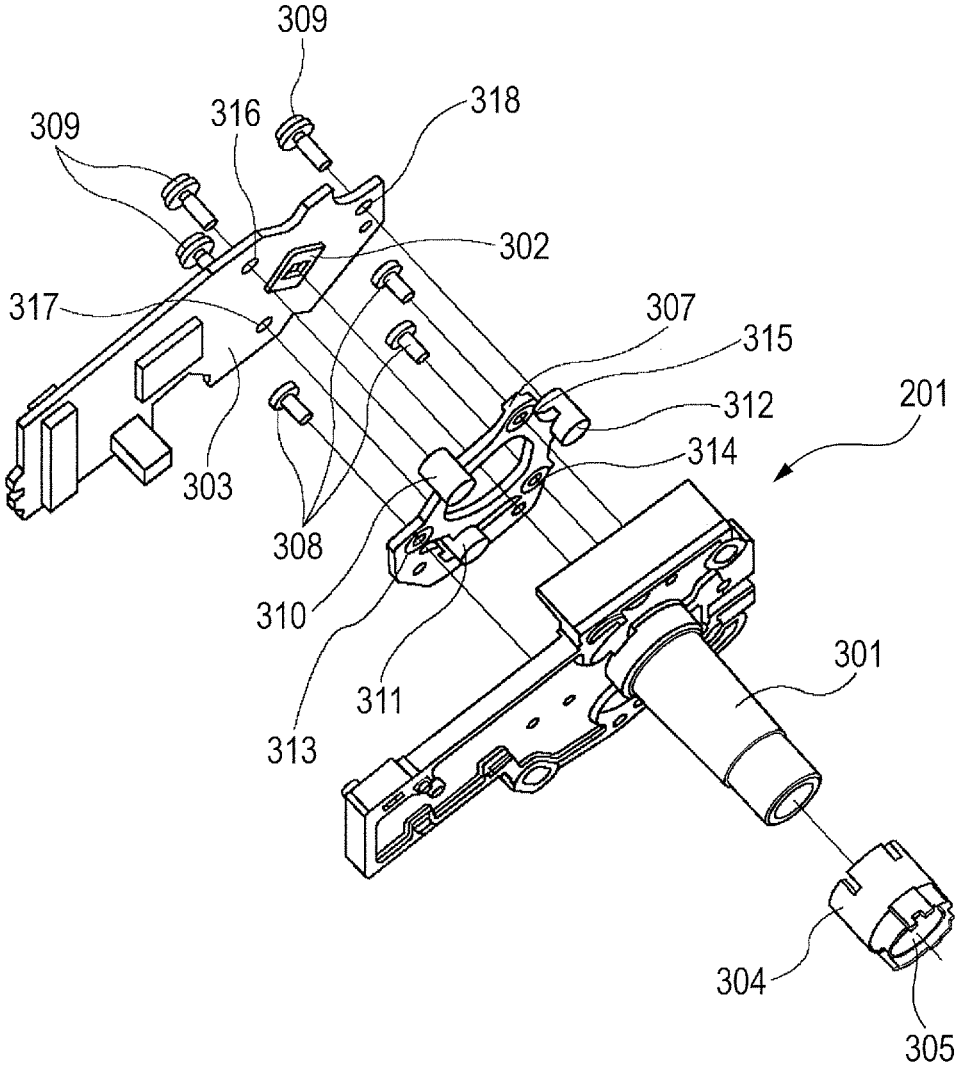
FIG. 3 is an exploded perspective view of an optical unit.

FIG. 3 is an exploded perspective view of the optical unit 201 to be attached to the light scanning apparatus 104. FIG. 3 is a perspective view from the side of a lens barrel described later.

The optical unit 201 includes a semiconductor laser 302 (e.g., a vertical cavity surface emitting laser) as a light source emitting laser light (light beam) and an electrical board 303 (hereinafter called a board 303) to drive the semiconductor laser 302. Hereinafter, the semiconductor laser 302 is called a VCSEL 302 for description. As shown in FIG. 3, the VCSEL 302 is mounted on the board 303.

A laser holder 301 is provided with a barrel 304, and at a tip end of the barrel 304 is attached a collimator lens 305. The collimator lens 305 converts laser light (diverging light) emitted from the VCSEL 302 into parallel light. The mounting position of the collimator lens 305 to the laser holder 301 is adjusted using a special jig during assembly of the light scanning apparatus 104 while detecting the irradiation position and focusing of the laser light emitted from the VCSEL 302. The installation position of the collimator lens 305 is decided, followed by bonding the collimator lens 305 to the laser holder 301 for fixing by irradiation of a UV curable adhesive applied between the collimator lens 305 and the barrel 304 with UV rays. The VCSEL 302 is electrically connected to the board 303, so that the VCSEL 302 emits lase light in response to a driving signal supplied from the board 303.

The following describes a method of fixing the board 303 with the VCSEL 302 mounted thereon to the laser holder 301, with reference to FIG. 3. In FIG. 3, a board supporting member 307 to fix the board 303 to the laser holder 301 is made of a material having elasticity. As shown in FIG. 3, the board supporting member 307 includes three fastening parts 310, 311 and 312 having screw holes to threadedly engage with screws 309 and three openings 313, 314 and 315 to let screws 308 pass therethrough. The screws 309 pass through openings 316, 317 and 318 provided at the board 303 and threadedly engage with the screw holes provided at the board supporting member 307. The screws 308 pass through the openings at the board supporting member 307 and threadedly engage with screw holes provided at the laser holder 301.

To assemble the optical unit, the board supporting member 307 is firstly fixed to the laser holder 301 with the screws 308. Next, the VCSEL 302 mounted on the board 303 is allowed to abut with an abutting part not shown provided at the laser holder 301. There is space between the board supporting member 307 and the board 303. Next, the screws 309 are fastened, thus elastically deforming the board supporting member 307 into a bow shape that is convex toward the laser holder 301. The ability to recover of the board supporting member 307 elastically deformed makes the board 303 abut against the abutting part, whereby the VCSEL 302 is fixed to the laser holder 301.

Figure 4A:
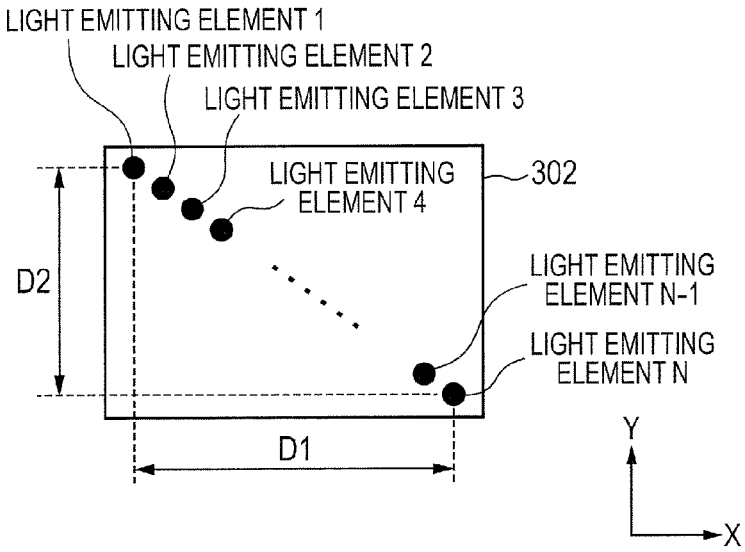
FIG. 4A schematically shows a light source.

The VCSEL 302 has a chip face, on which a plurality of light emitting elements are arranged in an array form as shown in FIG. 4A. Since these light emitting elements are arranged as shown in FIG. 4A, laser light L1 to Ln emitted from the light emitting elements form images at different positions on the photosensitive drum 102 in the main scanning direction. The laser light L1 to Ln emitted from the light emitting elements forms images at different positions in the vertical scanning direction (rotary direction) as well. Herein, the plurality of light emitting elements may be arranged two-dimensionally.

Figure 4B:
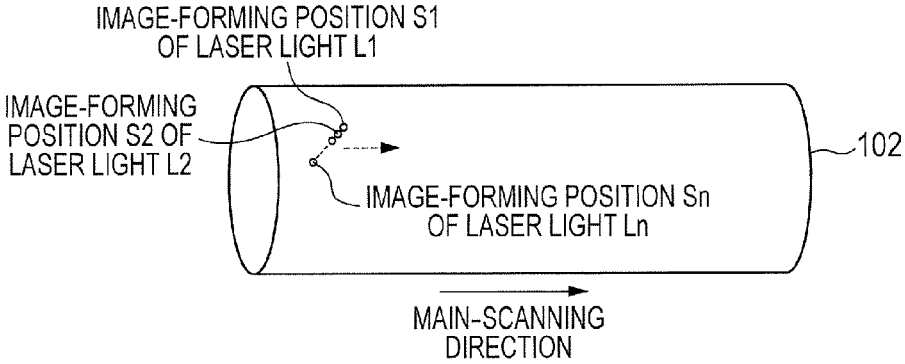
FIG. 4B shows a relative positional relationship of exposure positions of laser light on a photosensitive drum.

D1 in FIG. 4A denotes an interval (distance) between a light emitting element 1 and a light emitting element N that are arranged the farthest in X-axis direction. Since the light emitting element N is the farthest from the light emitting element 1 in X-axis direction among the plurality of light emitting elements, an image-forming position Sn of the laser light Ln becomes the farthest from an image-forming position S1 of the laser light L1 in the main scanning direction on the photosensitive drum 102 as shown in FIG. 4B. In the present embodiment, the light emitting element 1 and the light emitting element N are arranged at the light source 201 so that the laser light L1 precedes the laser light Ln to scan the photosensitive drum 102. Such arrangement of the light emitting element 1 and the light emitting element N makes the laser light L1 enter the BD 212 described later prior to the laser light Ln.

D2 in FIG. 4A denotes an interval (distance) between the light emitting element 1 and the light emitting element N that are arranged the farthest in Y-axis direction. Since they are arranged the farthest in Y-axis direction, as shown in FIG. 4B, the image-forming position Sn of the laser light Ln becomes the farthest from the image-forming position S1 of the laser light L1 in the vertical scanning direction on the photosensitive drum 102.

An interval between light emitting elements in Y-axis direction Py=D2/N−1 may be an interval corresponding to the resolution of the image forming apparatus (e.g., in the case of 1,200 dpi, about 21 μm), which is a value set by rotary adjustment of the light source 201 during assembly process so that an interval between image-forming positions of adjacent laser light in the vertical scanning direction on the photosensitive member corresponds to predetermined resolution. An interval between light emitting elements in X-axis direction Px=D1/N−1 is a value uniquely decided by the adjustment of light emitting elements in Y-axis direction to be Py. A timing when laser light is allowed to emit from each light emitting element after the generation of a synchronization signal by the BD 212 is set for the light emitting element using a predetermined jig during assembly process, and such a timing is stored as an initial value in a memory described later. This initial value is in association with Px.

Figure 4C:
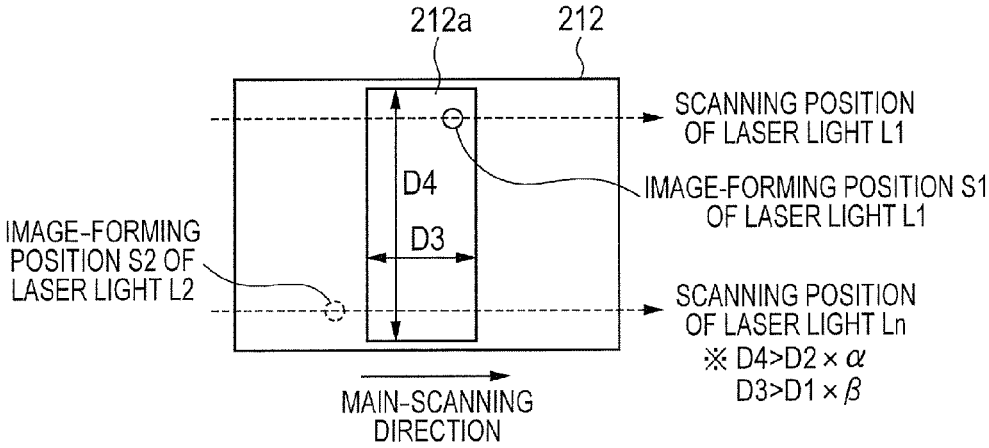
FIG. 4C schematically shows a BD.

FIG. 4C schematically shows the BD 212. The BD 212 includes a light receiving face 212*a* on which optic-electric conversion elements are arranged. Receiving laser light at the light receiving face 212*a*, a synchronization signal is generated. The BD 212 of the present embodiment receives laser light L1 through Ln and generates a plurality of BD signals corresponding to the laser light. The light receiving face 212*a* has a width in the main scanning direction set at D3 and has a width in the vertical scanning direction set at D4. As shown in FIG. 4C, laser light L1 emitted from the light emitting element 1 and laser light Ln emitted from the light emitting element N scan the light receiving face 212*a* of the BD 212. The width D4 corresponding to the vertical scanning line of the light receiving face 212*a* is set so that D4>D2×α (α: a variation of an interval between laser light L1 and laser light Ln passing through lens in vertical scanning direction). The width D3 of the light receiving face 212*a* in the main scanning direction is set so that D3<D1×β (β: a variation of an interval between laser light L1 and laser light Ln passing through lens in main scanning direction), thus preventing the laser light L1 and the laser light Ln emitted from the light emitting element 1 and the light emitting element N, respectively, turned on simultaneously from simultaneously entering the light receiving face 212*a*.

Figure 6:
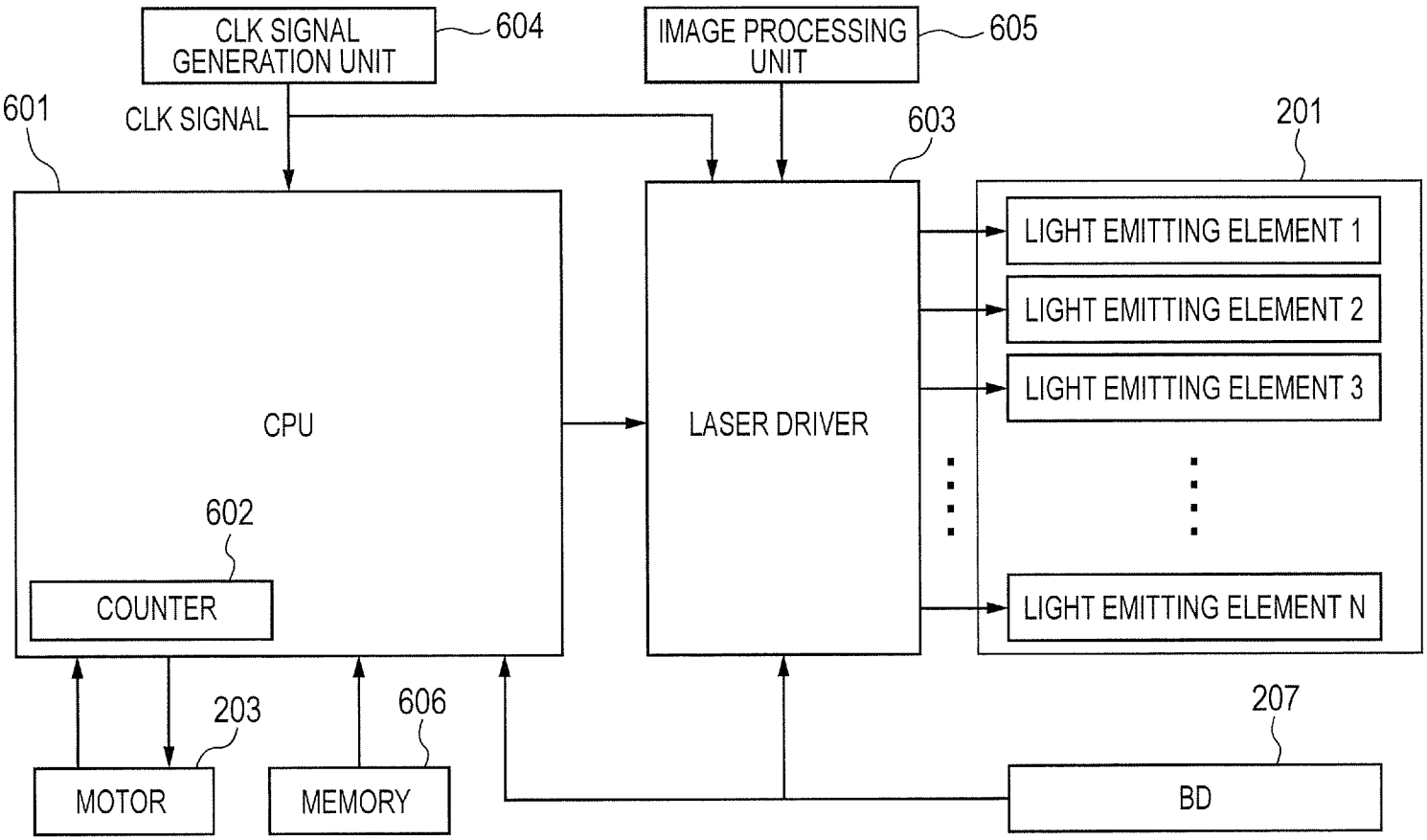
FIG. 6 is a control block diagram of the image forming apparatus according to the present embodiment.

FIG. 6 is a control block diagram of the image forming apparatus of the present embodiment. The image forming apparatus of the present embodiment includes a CPU 601, a counter 602 and a laser driver 603. The image forming apparatus of the present embodiment further includes a clock signal generation unit (CLK signal generation unit) 604, an image processing unit 605, a memory 606 and the motor 203 to rotary-drive the polygon mirror 202. The CPU 601 controls the image forming apparatus in accordance with a control program stored in the memory 606. The clock signal generation unit 604 generates a clock signal (CLK signal) of a predetermined frequency that is higher than the frequency of the output from the BD 212, and outputs the clock signal to the CPU 601 and the laser driver 603. The CPU 601 transmits a control signal in synchronization with the clock signal to the laser driver 603 and the motor 203.

The motor 203 is provided with a speed sensor not illustrated, the speed sensor being of a FG type (frequency generator type) that generates a frequency signal proportional to the rotation speed. The motor 203 outputs, to the CPU 601, a FG signal of a frequency corresponding to the rotation speed of the polygon mirror 202. The CPU 601 includes the counter 602 therein that is a counting unit, and the counter 602 counts clock signals input to the CPU 601. The CPU 601 measures the generation cycle of the FG signal on the basis of the count value by the counter 602, and when the generation cycle of the FG signal is within a predetermined cycle, the CPU 601 determines that the rotation speed of the polygon mirror 202 reaches a predetermined speed.

The CPU 601 receives a BD signal output from the BD 212. On the basis of the BD signal received, the CPU 601 transmits, to the laser driver 603, a control signal to control an emission timing of the laser light from the light emitting elements 1 to N. The laser driver 603 receives image data output from the image processing unit 605. The laser driver 603 supplies driving current based on image data to the light emitting elements at a timing based on the control signal transmitted from the CPU 601.

Figure 9A:
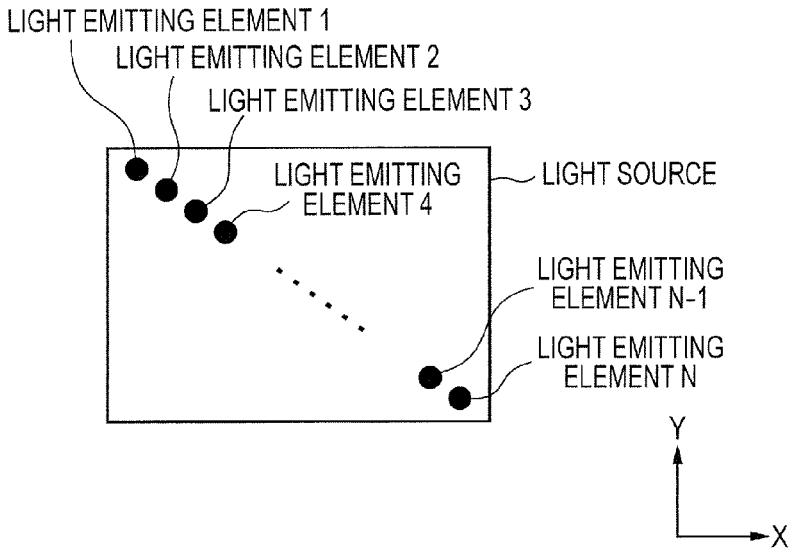
FIG. 9A describes a conventional light scanning apparatus and such an image forming apparatus.
Figure 9B:
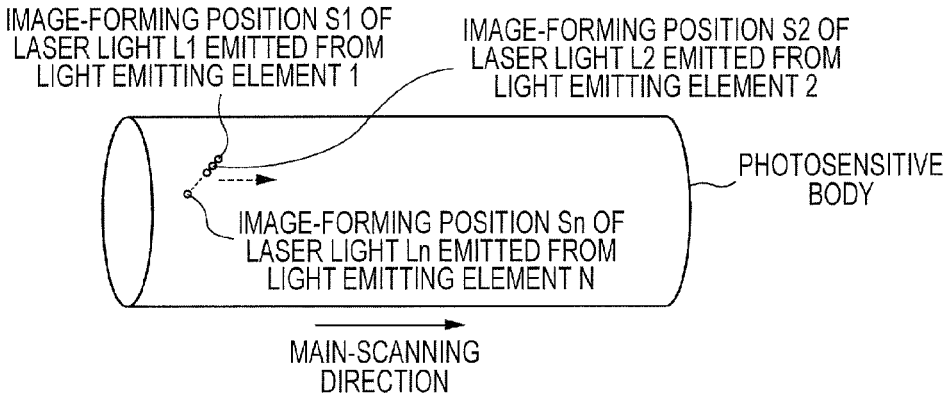
FIG. 9B describes a conventional light scanning apparatus and such an image forming apparatus.

As shown in FIG. 9B, image-forming positions S1 to Sn of laser light L1 to Ln are different in the main scanning direction. The conventional image forming apparatuses make one of the light emitting elements emit laser light to generate one BD signal. Then, an emission timing (fixed setting value) of a light beam is set for each of the plurality of light emitting elements with reference to the generated BD signal, and each light emitting element is allowed to emit laser light at the set emission timing, whereby the starting positions of electrostatic latent images (images) are brought into coincidence with each other in the main scanning direction.

Figure 9C:
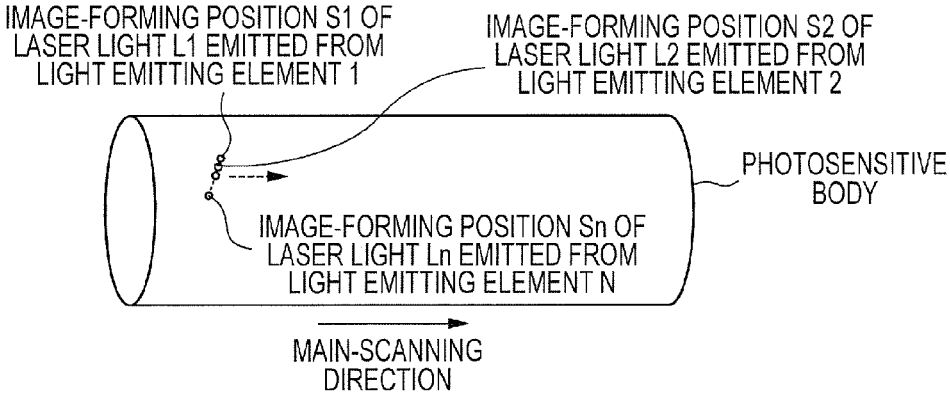
FIG. 9C describes a conventional light scanning apparatus and such an image forming apparatus.

During image formation, when the image-forming positions S1 to Sn keep their relative positional relationship constant, the starting positions of images can be made coincident by controlling the emission timing of laser light from the light emitting elements on the basis of the fixed setting value set for each light emitting element. However, temperature rise at the light source due to emission of laser light therefrom may cause fluctuations in wavelength of laser light emitted from the light emitting elements. Additionally, the temperature of the motor 203 may rise due to the rotation of the polygon mirror 202, and heat therefrom may cause a change of optical properties of the scanning lens. Such fluctuations in wavelength of laser light and a change in optical properties of the scanning lens may lead to change of the optical path of the laser light emitted from each light emitting element, thus changing the relative positional relationship among the image-forming positions S1 to Sn as shown in FIGS. 9B and 9C. That is, the exposure positions are arranged differently on the photosensitive drum. This causes a problem that the starting positions of electrostatic latent images formed by the laser light are not coincident in the main scanning direction.

Thus, the image forming apparatus of the present embodiment is configured to generate two BD signals from laser light L1 emitted from the light emitting element 1 and laser light Ln emitted from the light emitting element N. The CPU 601 controls a relative emission timing of laser light for a plurality of light emitting elements on the basis of a difference in generation timing (detection timing difference) between the two BD signals. The following describes this in detail.

Figure 7:
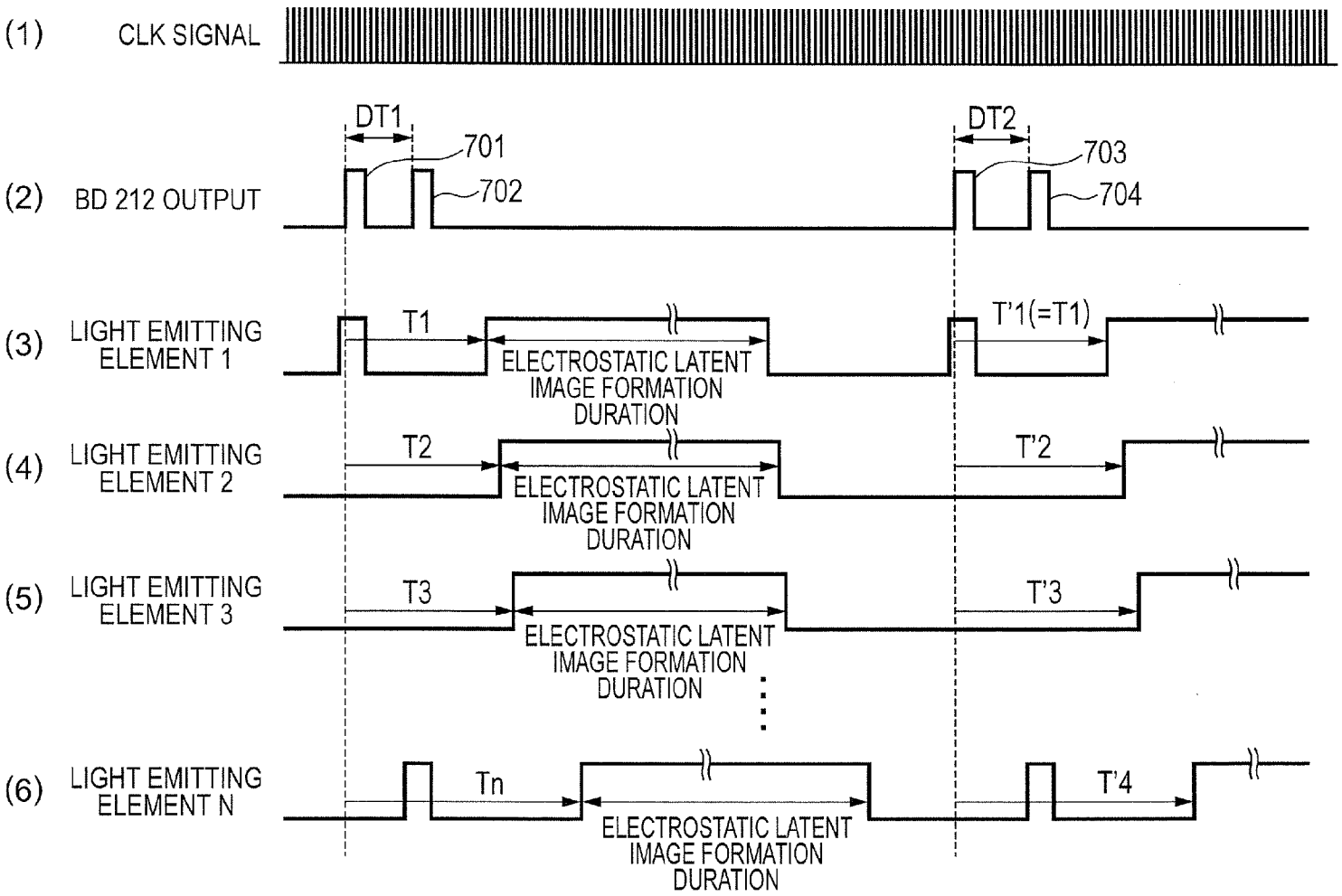
FIG. 7 is a timing chart in one scanning cycle according to the present embodiment.

FIG. 7 is a timing chart showing emission timings of laser light from the light emitting element 1 to the light emitting element N and output timings of BD signals from the BD 212. In this drawing, (1) shows a CLK signal and (2) shows output timings of BD signals from the BD 212. Then, (3) to (6) show emission timings of laser light from the light emitting element 1, the light emitting element 2, the light emitting element 3 and the light emitting element N, respectively.

In one scanning cycle of the laser light, the CPU 601 firstly controls the laser driver 603 so as to let the light emitting element 1 and the light emitting element N emit laser light. As a result, as shown in FIG. 7, the BD 212 outputs a BD signal 701 in response to the detection of the laser light L1 and outputs a BD signal 702 in response to the detection of the laser light Ln. The CPU 601 starts counting the CLK signals in response to the input of the BD signal 701, and acquires a count value Ca in response to the input of the BD signal 702. The count value Ca is detection data indicating a difference in generation timing DT1 between the BD signal 701 and the BD signal 702 in FIG. 7.

The memory 606 stores count values C1 through Cn corresponding to reference count value data Cref and Cref. The reference count value data Cref is reference data (predetermined data) corresponding to a generation timing difference Tref of a plurality of BD signals generated at any timing. Assume here that Cref is a generation timing difference of a plurality of BD signals generated in the initial state. Each of the count values C1 to Cn is a count value (starting timing data) to bring the starting positions by the light emitting elements into coincidence with each other in the main scanning direction when the generation timing difference of the generated plurality of BD signals is Tref. The count values C1 to Cn corresponds to T1 to Tn in FIG. 7, respectively.

The CPU 601 compares the count value Ca corresponding to the generation timing difference DT1 between the BD signal 701 and the BD signal 702 with Cref. When a result of the comparison is Ca=Cref, the CPU 601 turns the light emitting element 1 on in response to the count value of the CLK signal after generation of the BD signal 701 reaching C1 (after a lapse of T1). That is, as shown in FIG. 7, in response to the count value of the CLK signal after generation of the BD signal 701 reaching C1 (after a lapse of T1), duration for forming an electrostatic latent image by the light emitting element 1 is started. Then, the CPU 601 turns the light emitting element N on in response to the count value of the CLK signal after generation of the BD signal 701 reaching Cn (after a lapse of Tn). That is, as shown in FIG. 7, in response to the count value of the CLK signal after generation of the BD signal 701 reaching Cn (after a lapse of Tn), duration for forming an electrostatic latent image by the light emitting element N is started. Thereby, the electrostatic latent image (image) formed by the light emitting element 1 and the electrostatic latent image (image) formed by the light emitting element N can be brought into coincidence with each other in the starting position in the main scanning direction.

In the present embodiment, a laser light emission timing of each light emitting element is controlled with reference to a BD signal generated by the laser light L1. Alternatively, a laser light emission timing of each light emitting element may be controlled with reference to a BD signal generated by the laser light Ln. Still alternatively, a laser light emission timing of each light emitting element may be controlled with reference to any timing decided on the basis of a plurality of BD signals generated by the laser light L1 and the laser light Ln.

The following describes a method of deciding Cref. Firstly during the adjustment at the factory, the polygon mirror 202 is rotary-driven to let laser light L1 and laser light Ln enter the BD 212 in the state where the light source is at a reference temperature (e.g., 25° C.). Then, a difference in detection timing DTref between a BD signal generated by the laser light L1 and a BD signal generated by the laser light Ln is input to a measuring device. The measuring device is configured to receive a CLK signal from the clock signal generation unit 604 and convert the detection timing difference DTref into a count value. The measuring device decides this count value as Cref, and stores the count value in the memory 606.

During the adjustment, a light receiving device is disposed at a position corresponding to the starting position of a latent image on the photosensitive drum, and thus the light receiving device receives laser light L1 and Ln deflected by the polygon mirror 202. The light receiving device transmits, to the measuring device, light receiving signals indicating light receiving timing of the laser light L1 and light receiving timing of the laser light Ln. The measuring device converts a difference in generation timing between the BD signal generated by the laser light L1 and the light receiving signal generated by the light receiving device receiving the laser light L1 into a count value. This count value is C1, and the measuring devices stores this count value in the memory in association with Cref. On the other hand, the measuring device converts a difference in generation timing between the BD signal generated by the laser light L1 and the light receiving signal generated by the light receiving device receiving the laser light Ln into a count value. This count value is Cn, and the measuring devices stores this count value in the memory in association with Cref. The measuring device performs this processing to each light emitting element and stores C1 to Cn in the memory.

The memory may store C1 and Cn, and does not have to store starting timing data by a light emitting element M (light emitting element 2 to light emitting element N−1) located between the light emitting element 1 and the light emitting element N in X-axis direction of FIG. 4A. In this case, the CPU 601 calculates the starting timing data by the light emitting element M on the basis of C1, Cn and the arrangement position of the light emitting element M in X-axis direction with reference to the light emitting element 1 and the light emitting element N. That is, the CPU 601 calculates starting timing data Cm (count value) by the light emitting element M located between the light emitting element 1 and the light emitting element N using the following Equation 1:

$$Cm=(Cn-C1)\times(m-1)/(n-1)+C1=C1\times(n-m)/(n-1)+Cn\times(m-1)/(n-1) \quad \text{Equation 1.}$$

For instance, when the light source 201 includes four light emitting elements 1 to 4, the CPU 601 calculates starting timing data C2 and C3 by the light emitting elements 2 and 3 using the following Equations.

$$C2=C1+(C4-C1)\times 1/3=C1\times 2/3+C4\times 1/3 \quad \text{Equation 2}$$

$$C3=C1+(C4-C1)\times 2/3=C1\times 1/3+C4\times 2/3 \quad \text{Equation 3}$$

The following describes the case of a generation timing difference DT2 between a BD signal 703 and a BD signal 704. As shown in FIG. 7, the BD 212 outputs the BD signal 703 in response to detection of the laser light L1 and outputs the BD signal 704 in response to detection of the laser light Ln. The CPU 601 detects a generation timing difference DT'1 between the BD signal 703 and the BD signal 704 shown in FIG. 7 as a count value C'a. The CPU 601 compares the count value C'1 and Cref. Assume herein the case where C'a=Cref. The CPU 601 corrects starting timing data Cn on the basis of the difference between C'a and Cref to calculate C'n.

$$C'n=Cn\times K(Cref-C'1)\ (K \text{ is any coefficient including } 1) \quad \text{Equation 4}$$

In response to the count value of the counter 602 after generation of the BD signal 703 reaching the thus corrected starting timing data C'n, the CPU 601 turns the light emitting element N on. Regardless of a change of a generation timing difference of BD signals, the image formed by the light emitting element 1 and the image formed by the light emitting element N can be brought into coincidence with each other in the starting position in the main scanning direction.

Herein, the coefficient K is a coefficient that is to be multiplied to the variation (Cref−C'1) of time interval on the BD, which is determined by optical properties of the first fθ lens 204, the fθ lens 207 and the BD lens 214 provided at the light scanning apparatus.

Figure 5A:
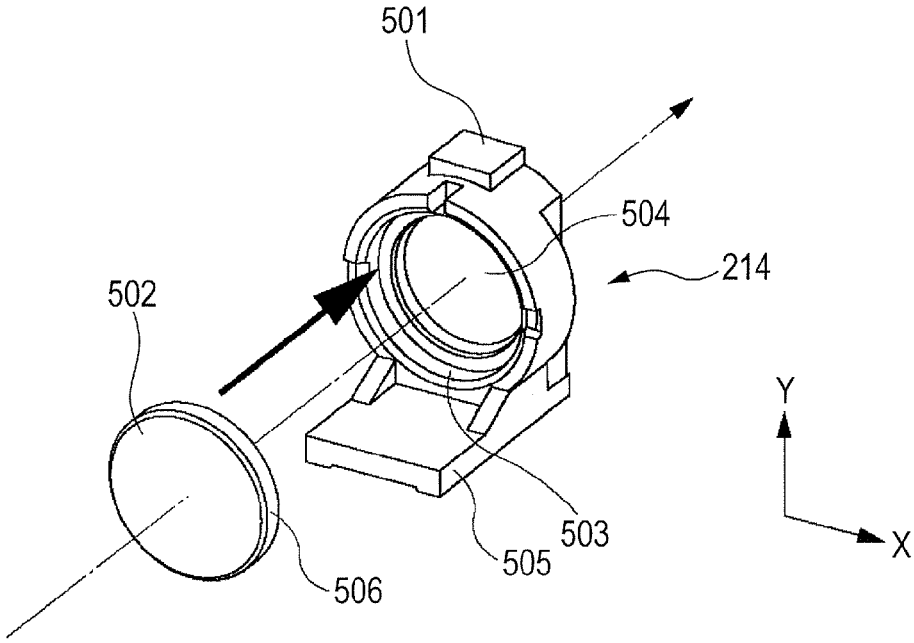
FIG. 5A is a perspective view of a BD lens.
Figure 5B:
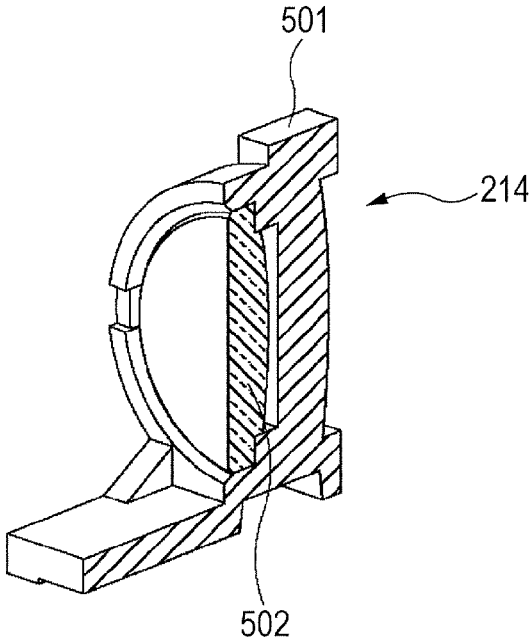
FIG. 5B is a cross-sectional view of the BD lens.

Referring to FIGS. 5A to 5B, the BD lens 214 is described below. In FIG. 5A, X-axis direction corresponds to the main scanning direction and Y-axis direction corresponds to the vertical scanning direction. That is, light incident on the BD lens 214 scans the incident face of the BD lens 214 (incident face of a lens 502 described later). A dot-dash arrow in FIG. 5A indicates the optical axis of the BD lens 214 and the traveling direction of the incident laser light. FIG. 5B is a cross-sectional view of the BD lens 214.

The BD lens 214 includes the lens 502 made of glass (second lens) and a lens 501 made of resin (third lens). The lens 502 has a refractive power to refract laser light incident on the lens 502 in X-axis direction. The lens 501 has a refractive power to refract laser light incident on the lens 501 in Y-axis direction. The lens 501 is a lens not having a refractive power to refract laser light incident on the lens 501 in X-axis direction. Laser light passing through the BD lens 214 enters the BD 212. The refractive power refers to light-gathering ability to gather laser light.

The lens 501 includes a holding part 503 to hold the lens 502 and a transmission part 504 to let a light beam pass therethrough. As shown in FIG. 5A, the lens 502 has a circular shape, and the holding part 503 has a circular shape that is slightly larger than an outline part 506 of the lens 502. As shown in FIG. 5B, the lens 502 is fitted to the holding part 503, whereby the lens 501 holds the lens 502. The lens 501 includes a supporting base 505 to support the holding part 503 and the transmission part 504, the supporting base 505 being integrally formed with the holding part 503 and the transmission part 504, and the supporting base 505 is installed at the bottom of the optical box 200.

A lens made of glass has a property that changes less than a lens made of resin due to heat. This means that, even when the internal temperature of the optical box rises due to the motor 203 driving the rotary polygon mirror 202, the refractive power of the lens 502 in X-axis direction changes less than that of a lens made of resin. The image forming apparatus of the present embodiment is configured to turn a plurality of light emitting elements on to generate a plurality of BD signals and control an emission timing of laser light from each light emitting element on the basis of a generation timing difference between the plurality of BD signals. To ensure the accuracy of this control, it is desirable to use the configuration where the refracting direction in X-axis direction of laser light passing through the BD lens 214 is less affected by the BD lens 214 and by the internal temperature of the optical box 200. To this end, the image forming apparatus of the present embodiment uses a lens made of glass as the lens 502 making up the BD lens 214 having a refractive power to refract light in X-axis direction.

Meanwhile, in order to reduce the cost, the first fθ lens 204 and the fθ lens 207 are made of resin. This configuration, however, leads to a problem as shown in FIGS. 9B to 9C because refractive powers of the first fθ lens 204 and the fθ lens 207 easily change due to a temperature rise. Thus, as described above, the CPU 601 lets a plurality of light beams enter the BD and on the basis of a generation timing difference between a synchronization signal generated by the BD receiving a light beam emitted from a first light emitting element and a synchronization signal generated by the BD receiving a light beam emitted from a second light emitting element, controls a relative emission timing of light beams among a plurality of light emitting elements. Such control executed by the CPU 601 can suppress displacement of the starting position of an electrostatic latent image in the main scanning direction even when the temperature of the fθ lens 207 rises.

Figure 8:
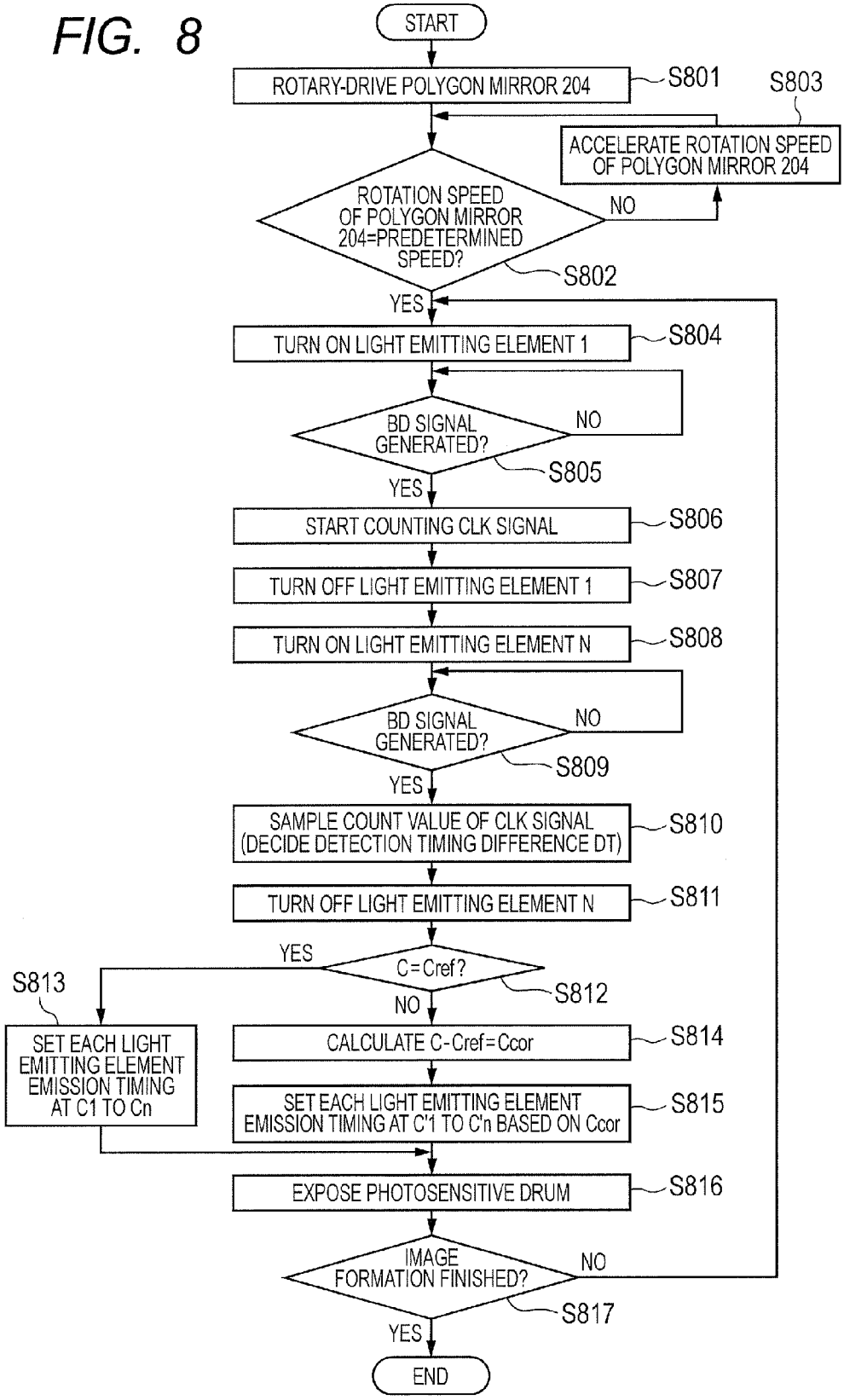
FIG. 8 is a control flow executed by a CPU included in the image forming apparatus according to the present embodiment.

Referring next to FIG. 8, the control flow executed by the CPU 601 is described below. This control is started in response to the input of image data to the image forming apparatus. Firstly in response to the input of image data, the CPU 601 drives a motor 203 to rotate the polygon mirror 202 (Step S801). At the subsequent Step S802, the CPU 601 determines whether the rotation speed of the polygon mirror 202 reaches a predetermined rotation speed or not (Step S802). When it is determined at Step S802 that the rotation speed of the polygon mirror 202 does not reach the predetermined rotation speed, the CPU 601 accelerates the rotation speed of the polygon mirror 202 (Step S803), and returns the control to Step S802.

At Step S802, when it is determined that the rotation speed of the polygon mirror 202 reaches the predetermined rotation speed, the CPU 601 turns the light emitting element 1 on (Step S804). Subsequently, the CPU 601 determines whether laser light L1 emitted from the light emitting element 1 generates a BD signal or not (Step S805). When it is determined at Step S805 that the laser light L1 does not generate a BD signal, the CPU 601 returns the control to Step S805 until the generation of a BD signal is detected. On the other hand, when it is determined at Step S805 that the laser light L1 generates a BD signal, the CPU 601 makes a counter start counting a CLK signal in response to the generation of the BD signal (Step S806).

Subsequent to Step S805, the CPU 601 turns the light emitting element 1 off (Step S807), and turns the light emitting element N on (Step S808). Subsequently, the CPU 601 determines whether laser light Ln emitted from the light emitting element N generates a BD signal or not (Step S809).

When it is determined at Step S809 that the laser light Ln does not generate a BD signal, the CPU 601 returns the control to Step S809 until the generation of a BD signal is detected. On the other hand, when it is determined at Step S809 that the laser light Ln generates a BD signal, the CPU 601 samples a count value of a CLK signal by the counter 602 in response to the generation of the BD signal (Step S810), and at the subsequent Step S811, the CPU 601 turns the light emitting element N off.

Following Step S811, the CPU 601 compares the sampled count value C with Cref and determines whether C=Cref or not (Step S812), and when it is determined that C=Cref, the CPU 601 sets emission timings of laser light corresponding to the light emitting elements with reference to the BD signal generated by the laser light L1 at C1 to Cn (Step S813). On the other hand, when it is determined at Step S812 that C≠Cref, the CPU 601 calculates Ccor=C−Cref (Step S814), and sets, based on the Ccor, emission timings of laser light corresponding to the light emitting elements with reference to the BD signal generated by the laser light L1 at C'1 to C'n (Step S815).

Following Step S813 or Step S815, the CPU 601 lets the light source emit laser light based on the image data in accordance with the emission timing of laser light set by each step, thus exposing the photosensitive drum to the light (Step S816). Following Step S816, the CPU 601 determines whether image forming is finished or not (Step S817). When it is determined that image forming is not finished, the CPU 601 returns the control to the Step S804. On the other hand, when it is determined at Step S817 that image forming is finished, the CPU 601 ends the control.

As described above, the image forming apparatus of the present embodiment includes a lens made of glass having a refractive power in the direction corresponding to the main scanning direction as at least a part of the BD lens 214. The thus configured image forming apparatus of the present embodiment makes the optical path of the laser light passing through the BD 212 less susceptible to a temperature change as compared with a BD lens made of resin having a refractive power in the direction corresponding to the main scanning direction.

According to the present invention, a synchronization signal is generated on the basis of a light beam passing through a second lens made of glass having a refractive power in the direction corresponding to the main scanning direction. As such, a variation of generation timing of the synchronization signal due to a variation of properties of the second lens can be suppressed. Especially using a lens made of glass as the second lens as in the present embodiment, a variation in generation timing difference of synchronization signal among a plurality of synchronization signals generated by a plurality of light beams can be suppressed as compared with the configuration including a lens made of resin as the second lens.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-100971, filed on Apr. 26, 2012, which is hereby incorporated by reference herein in its entirety.

What is claimed is:

1. A light scanning apparatus including a light source including a plurality of light emitting elements arranged therein such that each of light beams from the plurality of light emitting elements exposes a different position on a rotary-driven photosensitive member in a rotational direction of the photosensitive member, emission timings of the plurality of light beams from the plurality of light emitting elements being controlled on a basis of a synchronization signal, the light scanning apparatus comprising:

a deflection unit configured to deflect a plurality of light beams such that the plurality of light beams scans the photosensitive member;

a light receiving element that receives the light beam deflected by the deflection unit and generates the synchronization signal based on the reception of the light beam deflected by the deflection unit;

a first lens configured to guide the plurality of light beams deflected by the deflection unit onto the photosensitive member; and a second lens made of glass disposed on an optical path of the light beam deflected by the deflection unit and guiding the light beam deflected by the deflection unit onto the light receiving element, wherein the second lens focuses the light beam deflected by the deflection unit in a direction corresponding to a scanning direction of the plurality of the light beams, and wherein the light beam which has passed through the second lens does not expose the photosensitive member.

2. The light scanning apparatus according to claim 1, further comprising a third lens made of resin, the third lens made of resin being disposed between the second lens made of glass and the light receiving element on an optical path of a light beam passing through the second lens made of glass so that the light beam enters the lens made of resin, the third lens made of resin gathering an incident light beam in a direction corresponding to the rotational direction of the photosensitive member.

3. The light scanning apparatus according to claim 2, wherein the third lens made of resin focuses the incident light beam in a direction corresponding to the scanning direction, and the second lens made of glass has a refractive power in the direction corresponding to the scanning direction that is larger than a refractive power of the third lens made of resin in the direction corresponding to the scanning direction.

4. The light scanning apparatus according to claim 2, wherein the third lens made of resin includes a transmission part and a holding part, the transmission part having an optical property of letting the light beam passing through the second lens made of glass pass therethrough and gathering the light beam in a direction corresponding to the rotational direction of the photosensitive member, the holding part holding the second lens made of glass.

5. The light scanning apparatus according to claim 4, wherein the holding part is fitted to an outline part of the second lens made of glass.

6. The light scanning apparatus according to claim 1, wherein at least a part of light emitting elements among the plurality of light emitting elements are arranged in the light source so that different positions in the scanning direction are exposed to light beams emitted from the part of light emitting elements.

7. The light scanning apparatus according to claim 6, further comprising a driving unit that makes each of the plurality of light emitting elements emit a light beam for exposure of the photosensitive member with reference to a timing when the synchronization signal is generated.

8. An image forming apparatus, comprising:

the light scanning apparatus according to claim 6; and a driving unit that makes each of the plurality of light emitting elements emit a light beam for exposure of the photosensitive member with reference to a timing when the synchronization signal is generated.

9. The image forming apparatus according to claim 8, further comprising a control unit that controls the driving unit, wherein the control unit makes a first light emitting element and a second light emitting element included in the part of light emitting elements emit light beams at different timings, and controls a relative emission timing of light beams among the plurality of light emitting elements on a basis of a generation timing difference between a synchronization signal generated by the light receiving element receiving the light beam emitted from the first light emitting element and a synchronization signal generated by the light receiving element receiving the light beam emitted from the second light emitting element.

10. The light scanning apparatus according to claim 1, wherein the first lens is made of resin where the plurality of light beams deflected by the deflection unit enter, the first lens refracting the incident plurality of light beams in the scanning direction where the plurality of light beams scan the photosensitive member.

11. The light scanning apparatus according to claim 10, wherein the first lens refracts the incident plurality of light beams, thus converting a scanning speed of the plurality of light beams on the photosensitive member.

12. The light scanning apparatus according to claim 11, wherein the second lens gathering the light beam is disposed on an optical path of a light beam passing through the first lens.

* * * * *